US009873540B2

(12) United States Patent
Skinner

(10) Patent No.: US 9,873,540 B2
(45) Date of Patent: Jan. 23, 2018

(54) CONTAINER APPARATUS

(71) Applicant: ICEE HOLDINGS PTY. LTD., Tullamarine, Victoria (AU)

(72) Inventor: Leslie John Skinner, Tullamarine (AU)

(73) Assignee: ICEE HOLDINGS PTY LTD., Victoria (AU)

( * ) Notice: Subject to any disclaimer, the term of this patent is extended or adjusted under 35 U.S.C. 154(b) by 0 days.

(21) Appl. No.: 15/032,030

(22) PCT Filed: Oct. 24, 2014

(86) PCT No.: PCT/AU2014/001004
§ 371 (c)(1),
(2) Date: Apr. 25, 2016

(87) PCT Pub. No.: WO2015/058246
PCT Pub. Date: Apr. 30, 2015

(65) Prior Publication Data

US 2016/0257442 A1 Sep. 8, 2016

(30) Foreign Application Priority Data

Oct. 25, 2013 (AU) ..... 2013904133
May 7, 2014 (AU) ..... 2014901686

(51) Int. Cl.
*B65D 5/20* (2006.01)
*B65D 5/02* (2006.01)
(Continued)

(52) U.S. Cl.
CPC ..... *B65D 5/02* (2013.01); *B65D 1/225* (2013.01); *B65D 5/20* (2013.01); *B65D 5/6605* (2013.01); *B65D 81/3816* (2013.01)

(58) Field of Classification Search
None
See application file for complete search history.

(56) References Cited

U.S. PATENT DOCUMENTS 3,675,808 A * 7/1972 Brink ..... B65D 1/225 206/509
4,010,865 A * 3/1977 Wilgus ..... B65D 11/1833 220/6
(Continued)

FOREIGN PATENT DOCUMENTS

DE 19512823 A1 * 10/1996 ..... B65D 1/22
GB 2138782 A 10/1984
JP 05139441 A 6/1993

OTHER PUBLICATIONS

International Search Report for International Application No. PCT/AU2014/001004 dated Dec. 23, 2014 (5 pages).

*Primary Examiner* — Christopher Demeree
*Assistant Examiner* — Phillip Schmidt
(74) *Attorney, Agent, or Firm* — Merchant & Gould P.C.

(57) ABSTRACT

A container (10) consists of a substantially planar blank having a plurality of regions, the regions including a base (18), side walls (14), end walls (16) and a lid (12). Each of the regions is connectable to at least one of the other regions by a hinge (20) formed within the blank. The blank is able to be converted into a first unassembled configuration in which regions of the blank are pivoted around the hinges (20) connecting the regions in relation to other regions, to form a rectangular slab in which compact mode blanks are able to be stacked, and a second configuration in which the blank is erected to form the container (10), which has a cuboidal structure of substantially uniform cross-section, for the storage of articles. The hinge (20) comprises a recess (32) the recess (32) defining a point (30) of minimum cross section, said point (30) forming the pivot point (30) about which pivotal movement of adjacent regions occurs, wherein opposing side walls (33, 35) of the recess (32) are configured to interengage when one of the regions is pivotally moved through a 90° arc relative to an adjacent region,
(Continued)

said interengagement comprising meshing of at least one stepped region (34) of a side wall (35) with a surface of the opposing side wall (33). The base (58) of a container (50) may also include ledge portions (60) at each of the corners of the base (58), which ledge portions (60) provide support for hinges (70) when the container is in the cuboidal configuration.

9 Claims, 14 Drawing Sheets

(51) Int. Cl.

| | |
|---|---|
| ***B65D 1/22*** | (2006.01) |
| ***B65D 81/38*** | (2006.01) |
| ***B65D 5/66*** | (2006.01) |

(56) References Cited

U.S. PATENT DOCUMENTS

| | | | | | |
|---|---|---|---|---|---|
| 4,170,313 | A | | 10/1979 | Caves et al. | |
| 4,235,346 | A | * | 11/1980 | Liggett | B65D 1/225 220/6 |
| 5,316,165 | A | * | 5/1994 | Moran, Jr. | H02G 3/10 220/3.2 |
| 2012/0024941 | A1 | | 2/2012 | Skinner | |

* cited by examiner

CONTAINER APPARATUS

This application is a National Stage Application of PCT/AU2014/001004, filed 24 Oct. 2014, which claims benefit of Serial No. 2013904133, filed 25 Oct. 2013 in Australia and Serial No. 2014901686, filed 7 May 2014 in Australia and which applications are incorporated herein by reference. To the extent appropriate, a claim of priority is made to each of the above disclosed applications.

FIELD OF THE INVENTION

The present invention relates generally to a container apparatus, and in particular, to a container apparatus that is made from a single piece of material that is configured to be folded to form an assembled structure.

BACKGROUND OF THE INVENTION

In an ever increasing consumer society, the need to provide packaging and containers to contain, transport and/or store a variety of items remains an important requirement. Over time, a variety of solutions have been proposed for this satisfying this requirement, with varying degrees of success.

In this regard, cardboard boxes have proven to be a popular form of packaging for a variety of reasons. Cardboard can be created relatively cheaply and can be simply formed into blanks that are able to be stored and transported in a flat form and simply folded to form a box as desired. Cardboard boxes can be made to a variety of sizes and can be reinforced as required through the use of tape or stables to withstand a degree of force. However, due to the nature of cardboard it has limited durability and can be particularly susceptible to failure when exposed to liquids impact and other types of treatment which can cause the cardboard boxes to fail and lose structural integrity.

With the widespread acceptance of plastic materials, such as expandable polystyrene (EPS), the ability to utilise these materials and their inherent properties to provide improved containers has been realised. EPS boxes have a particular application for the storage and transport of perishable materials, such as agricultural and horticultural products, as they are largely impermeable and as such provide an environment for storing items which can be temperature regulated as retained in a gas-tight or water-tight state. Due to the nature of EPS, boxes formed from EPS also have a degree of shock and impact resistance which provides protection to the materials stored or carried therein.

However, despite the various benefits that material such as EPS provide for packaging purposes, due to the manner in which EPS is formed to be expanded within a mould, most boxes or packaging formed from such materials are formed to shape as a single piece. Whilst this is useful as it ensures a dimensionally accurate final product, the resultant product occupies a volume even when empty, thereby requiring space to store when not in use and making them less economic to store and transport when empty. Thus after use, it is common for such EPS boxes to be broken down and placed in land-fill and not be reused.

A variety of systems have been proposed for making EPS boxes in a flat blank form and assembling the boxes for use. This is generally achieved through the formation of hinges in the EPS blank during the moulding process and/or by applying a compression force to the blank at predetermined regions. This method is described in more detail in the Applicant's International PCT Patent Application No. PCT/AU2010/000340.

Whilst the above methods have proven effective in enabling boxes to be assembled from a flat EPS blank, there is a need to further improve the EPS box formed in such a manner to provide improved strength and storability when not in use or when being transported in an empty form.

The above references to and descriptions of prior proposals or products are not intended to be, and are not to be construed as, statements or admissions of common general knowledge in the art. In particular, the above prior art discussion does not relate to what is commonly or well known by the person skilled in the art, but assists in the understanding of the inventive step of the present invention of which the identification of pertinent prior art proposals is but one part.

SUMMARY OF THE INVENTION

The invention according to one or more aspects is as defined in the independent claims. Some optional and/or preferred features of the invention are defined in the dependent claims.

The invention provides container apparatus characterised by:

a substantially planar blank member having a plurality of predetermined regions formed therein for defining a base, side walls, and end walls of the container, each of said plurality of predetermined regions being connectable to at least one other of said plurality of predetermined regions by a hinge member formed within the blank member, said blank member being adapted to be erected into a first configuration whereby the blank member forms the container apparatus, and into a second configuration whereby the blank member forms a substantially rectangular body of substantially uniform cross-section for storage of articles.

The invention also provides a hinge member for facilitating pivotal movement between integrally formed adjacent planar surfaces, characterised by a recess formed between said integrally formed adjacent planar surfaces, said recess defining a channel of minimum cross section, said channel forming said pivot point about which pivotal movement of the said planar surfaces is facilitated, such that opposing side walls of said recess are configured to interengage when said planar surfaces are pivotally moved through an arc relative to each other, said interengagement comprising meshing of at least one stepped region of one of said side walls with a surface of an opposing one of said side walls.

The invention further provides a container blank including a base and a plurality of side walls, each of said plurality of side walls being connected to said base by a hinge, such that each of said plurality of side walls is able to be pivoted about a respective hinge, relative to said base, to form said container, characterised in that ledge portions are provided on said base, said ledge portions extending from said base, thereby providing support for said hinge when said blank is erected to form said container.

BRIEF DESCRIPTION OF THE DRAWINGS

The invention may be better understood from the following non-limiting description of preferred embodiments, in which.

DETAILED DESCRIPTION OF THE DRAWINGS

Preferred features and embodiments of the present invention will now be described with particular reference to the accompanying drawings. However, it is to be understood that the features illustrated in and described with reference to the drawings are not to be construed as limiting on the scope of the invention.

The present invention employs the methods and tooling for forming the blanks as described in the Applicant's earlier filed International PCT Patent Application No. PCT/AU2010/000340. As such, no further description will be provides as to the means for forming the blanks.

In the description below, the present invention will be described in relation to its application for a box made from EPS. It will be appreciated that the concepts associated with the present invention could be employed in the formation of a variety of other types of structures made from EPS or similar materials, such as pods used in building construction, ducts for use in air conditioning and the like, as well as any other assembled products not currently envisaged.

Figure 1:
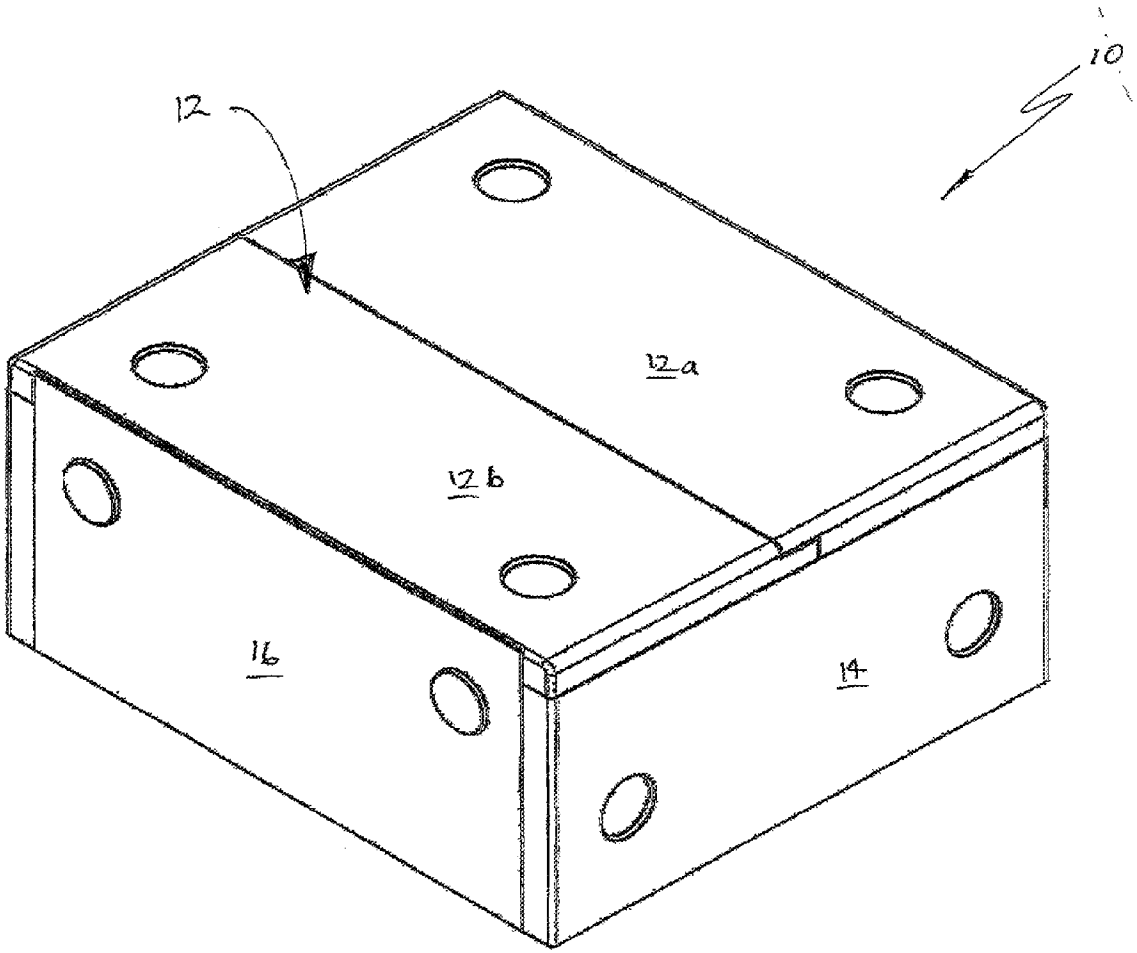
FIG. 1 is a perspective view of an assembled container in accordance with an embodiment of the present invention.

Referring to FIG. 1, a container 10 in accordance with an embodiment of the present invention is shown. The container 10 is in the form of a blank that is assembled into a rectangular box having a lid 12, opposing side walls 14 and opposing end walls 16. A base 18 forms the base of the container 10 such that the interior of the container represents an enclosed space into which items can be stored or contained as required.

The container 10 is preferably made from EPS with the lid 12, side walls 14, end walls 16 and base 18 having a maximum thickness of between 20-30 mm, preferably around 25 mm. However, other thicknesses are also envisaged.

Figure 2:
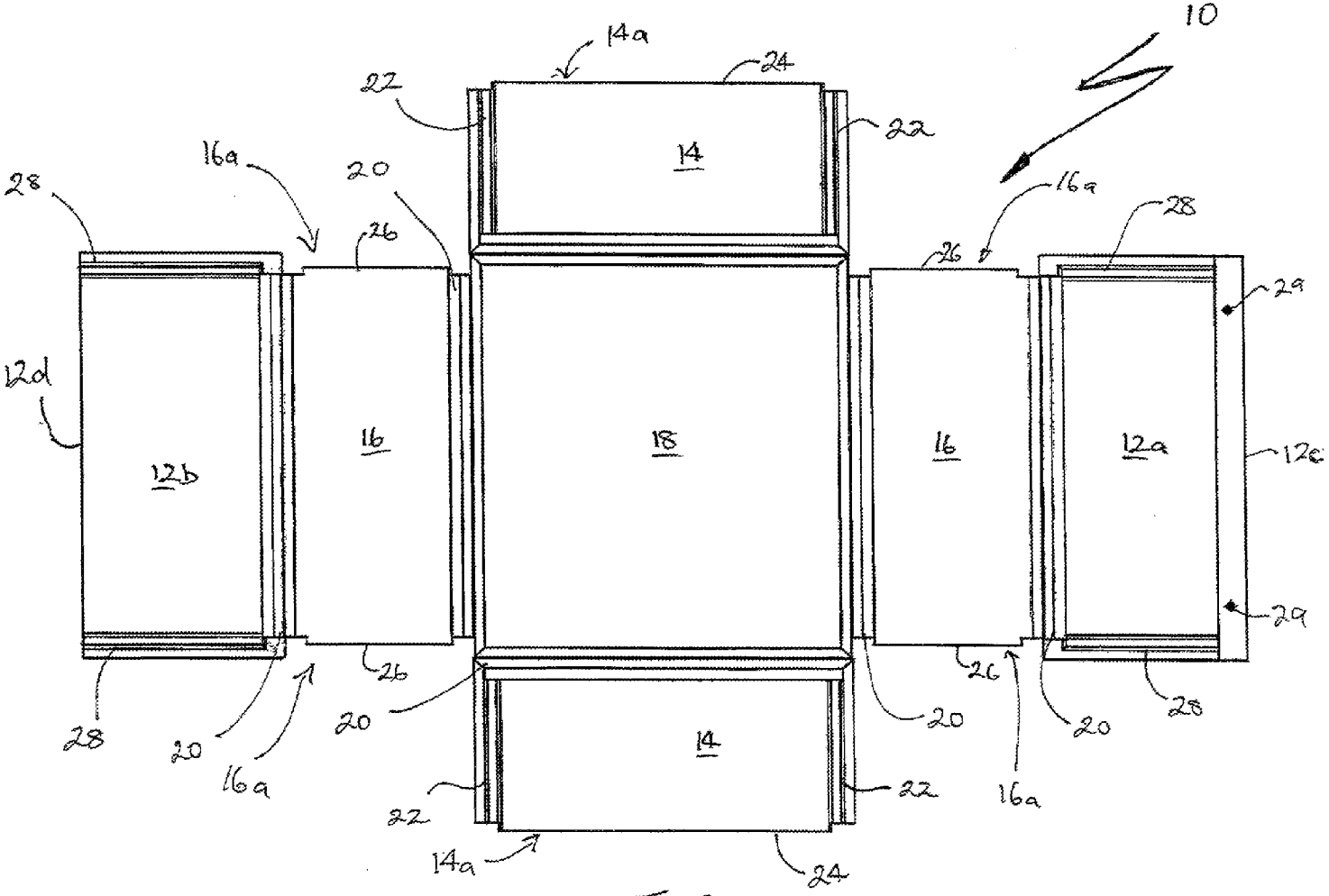
FIG. 2 is a top view of the unassembled container of FIG. 1.
Figure 3:
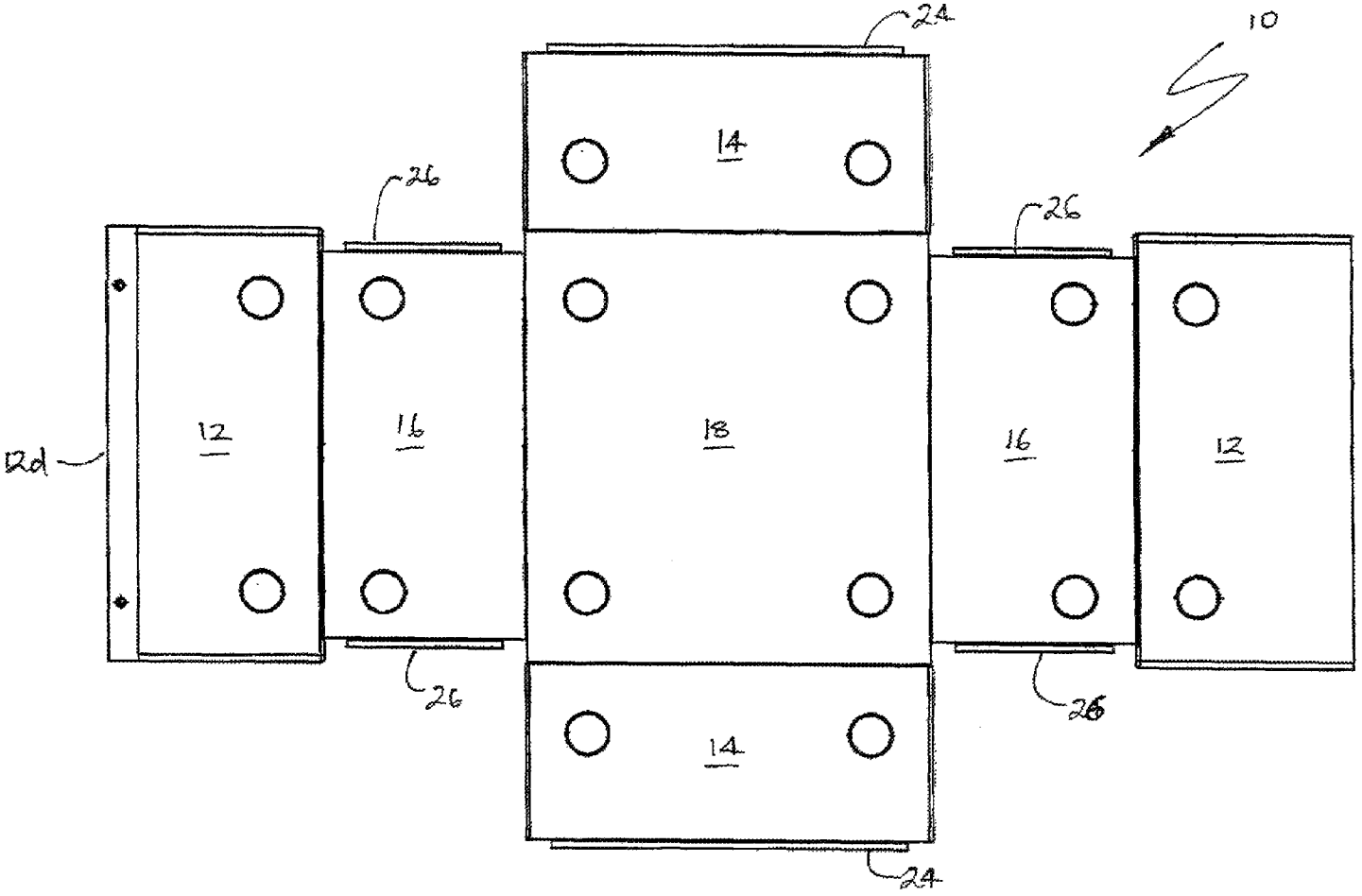
FIG. 3 is a bottom view of the unassembled container of FIG. 1.

As is shown in FIGS. 2 and 3, the container 10 is formed from a substantially flat blank. A plurality of hinges 20 are formed between where the lid 12, side walls 14, end walls 16 and base 18 meet to facilitate bending of the lid 12, side walls 14, end walls 16 and base 18 into the position as shown in FIG. 1. The hinges 20 are formed on the internal, surfaces of the blank as shown and the manner in which the hinges 20 are configured will be described in more detail below.

To facilitate assembly of the various portions of the blank, the side walls 14 each comprise a groove or channel 22 formed at either end of the side wall 14. The groove or channel 22 extends perpendicular to the hinge 20 that connects the side wall 14 to the base 18 and extends substantially the height of the side wall 14 as is best depicted in FIG. 2. The upper edge 14*a* of each side wall 14, namely the edge of the side wall 14 opposite and parallel to the hinge 20 that connects the side wall 14 to the base 18 has a lip 24 formed thereon. The lip 24 extends between the grooves or channels 22 formed at opposing ends of the side wall 14 and comprise a continuation of the side wall 14 having a reduced thickness in comparison to the remainder of the side wall 14. In a preferred form, the lip 24 extends approximately 7 mm beyond the upper edge 14*a* of the side wall and has a thickness of approximately 9-10 mm, with the remainder of the side wall having a thickness of around 20 mm.

Each of the end walls 16 are attached along a lower edge thereof to the base 18 by hinge 20 and at an upper edge thereof to a portion of the lid 12 by way of another hinge 20. The free ends 16*a* of the end walls, namely those ends that extend between and orthogonal to the hinges 20, are also provided with a rib member 26 that extends beyond the free ends 16*a* in a continuous manner as shown in FIG. 2. The rib members 26 function in a similar manner to the lip 24 of the side walls 14 and comprise a continuation of the end wall 16 having a reduced thickness in comparison to the remainder of the end wall 16. In a preferred form, the rib members 26 extend approximately 7 mm beyond the free ends 16*a* of the end walls and have a thickness of approximately 9-10 mm, with the remainder of the end wall having a thickness of around 20 mm.

As shown in FIG. 1, the lid 12 comprises two substantially identical lid members 12*a* and 12*b*. Each of the lid members 12*a* and 12*b* have a channel 28 formed along opposing sides thereof extending perpendicular to the hinge 20 that connects the lid members 12*a*, 12*b* to the corresponding end walls 16. The channel 28 function in a similar manner to the grooves or channels 22 formed at either end of the side wall 14, the purpose of which will be described in more detail below.

Figure 4:
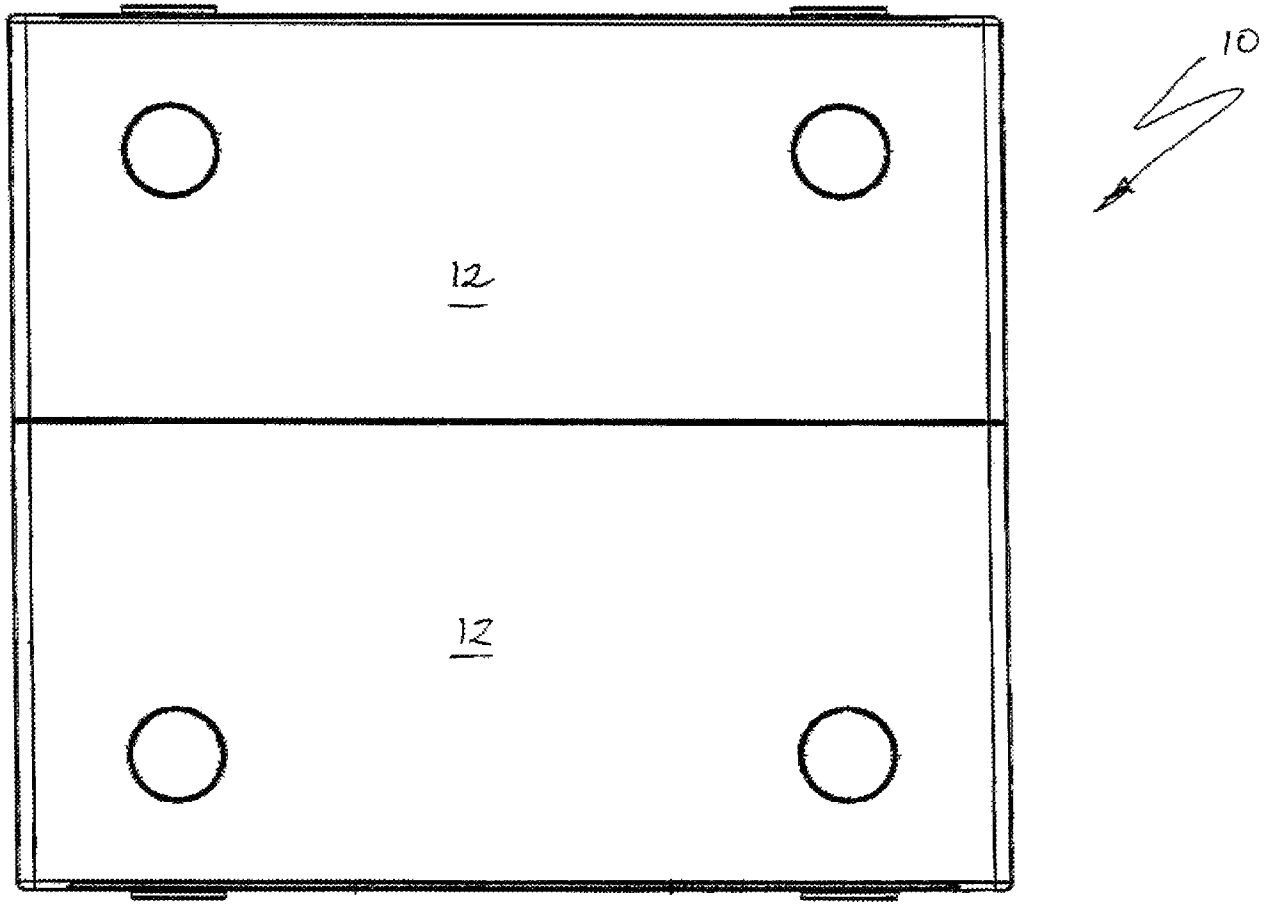
FIG. 4 is a top view of the assembled container of FIG. 1.

Each of the free ends 12*c* and 12*d* of the lid members 12*a* and 12*b* respectively, are configured to inter-engage when assembled to facilitate scaling closure of the lid 12, as shown in FIG. 1. In this regard, the free end 12*c* of lid member 12*a* has a stepped region formed therein which is of reduced thickness to the remainder of the lid member 12*a*. The surface of the stepped region of the free end 12*c* has one or more projections 29*a* extending therefrom. The projections 29*a* are preferably formed from as part of the moulding process and are formed from EPS, although other materials are also envisaged. To facilitate engagement between the lid members 12*a* and 12*b*, the free end 12*d* of lid member 12*b* also has a stepped region formed therein, which substantially matches the stepped region formed in the free end 12*c* of the lid member 12*a* when the lid members 12*a* and 12*b* are brought together. As is best seen in FIG. 3, the outer surface of the stepped region of the free end 12*d* has one or more recesses 29*b* formed therein which are configured to mate with the projections 29*a* formed on the stepped region of free end 12*c* thereby providing engagement between the lid members 12*a* and 12*b* to close the lid when the container 10 is assembled in the manner shown in FIG. 4.

Figure 5:
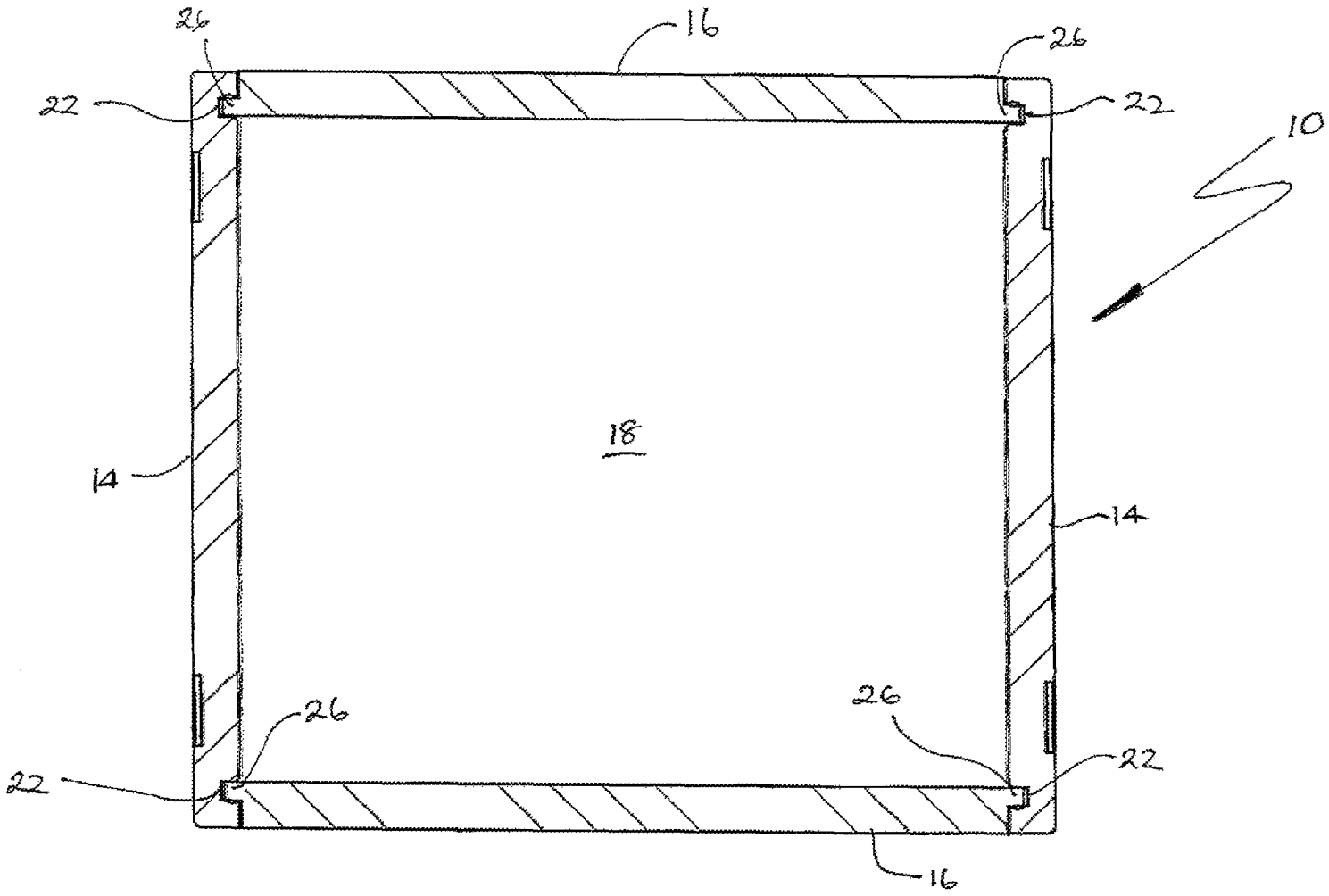
FIG. 5 is a cross-sectional top view of the assembled container of FIG. 1.
Figure 6:
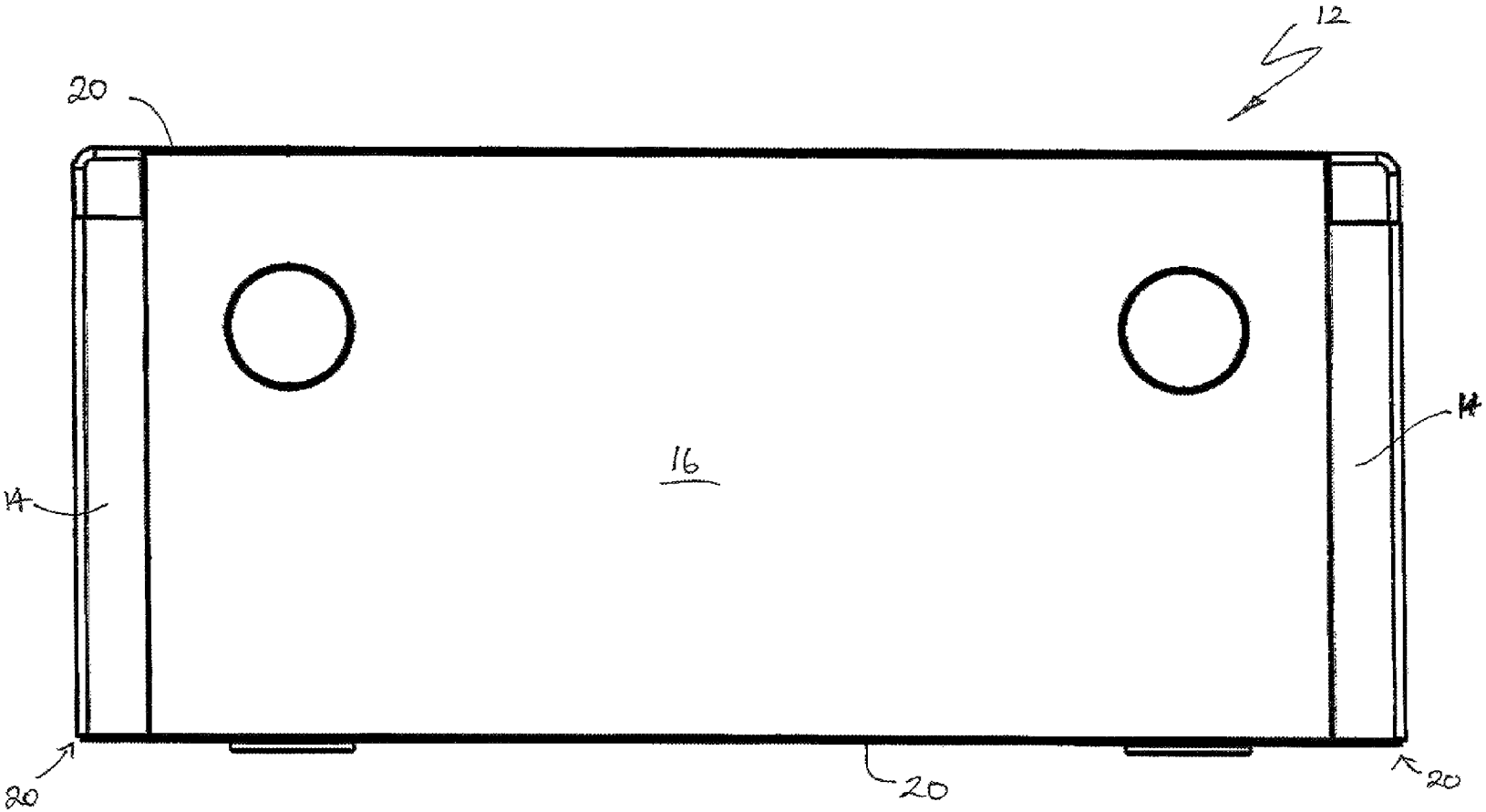
FIG. 6 is an end view of the assembled container of FIG. 1.

Referring to FIG. 5, the manner in which the end walls 16 and side walls 14 fit together to form the assembled container 10 is shown. The end walls 16 are initially folded into an upright position through a 90° arc. The side walls 14 are then folded into an upright position with respect to the base 18 through a 90° are such that the rib members 26 of the end walls 16 are received within the grooves or channels 22 formed in the side walls 14. The rib members 26 may have a width slightly greater than the width of the grooves or channels 16 to facilitate a degree of interference fit therebetween to provide a degree of positive engagement between the side walls 14 and the end walls 16 when in the upright position as shown in FIG. 6.

Once the side walls 14 and the end walls 16 are in the upright position, the lid members 12*a* and 12*b* are able to be lowered into position to extend across the open container 10 and enclose the space contained therein. In this regard, with the side wall 14 in the upright position, the lip 24 extends above the upper edge 14*a* thereof. The groove 28 formed along opposing edges of the lid members 12*a* and 12*b* is able to be positioned such that the lip 24 is received within the groove 28 thereby providing a positive engagement between the lid members 12*a* and 12*b* and the side walls 14 which increases the strength of the container and creates a seal about the container 10.

It is to be understood that the lid 12 of the container 10 may be omitted. Many customers for a container of the type described in this specification require an open-topped container. In such a configuration, the erected container 10, in the absence of a lid 12 or lid members 12*a*, 12*b*, is an open topped container, which may be encased in some kind of strapping or wrapping, which may preferably be wound around the side walls 14 to impart strength to the erected container. A preferred type of wrapping may be plastic film of the type commonly used to wrap articles. Alternatively, lid members 12*a*, 12*b* may be vestigial, locking into side walls 14 to produce a strong erected container 10, but with that erected container 10 substantially open. A further alternative would be to have a one-piece lid 12, which would be hingedly connected to one of the side walls 14, and adapted to interengage with the other side walls to form an erected container.

Figure 7:
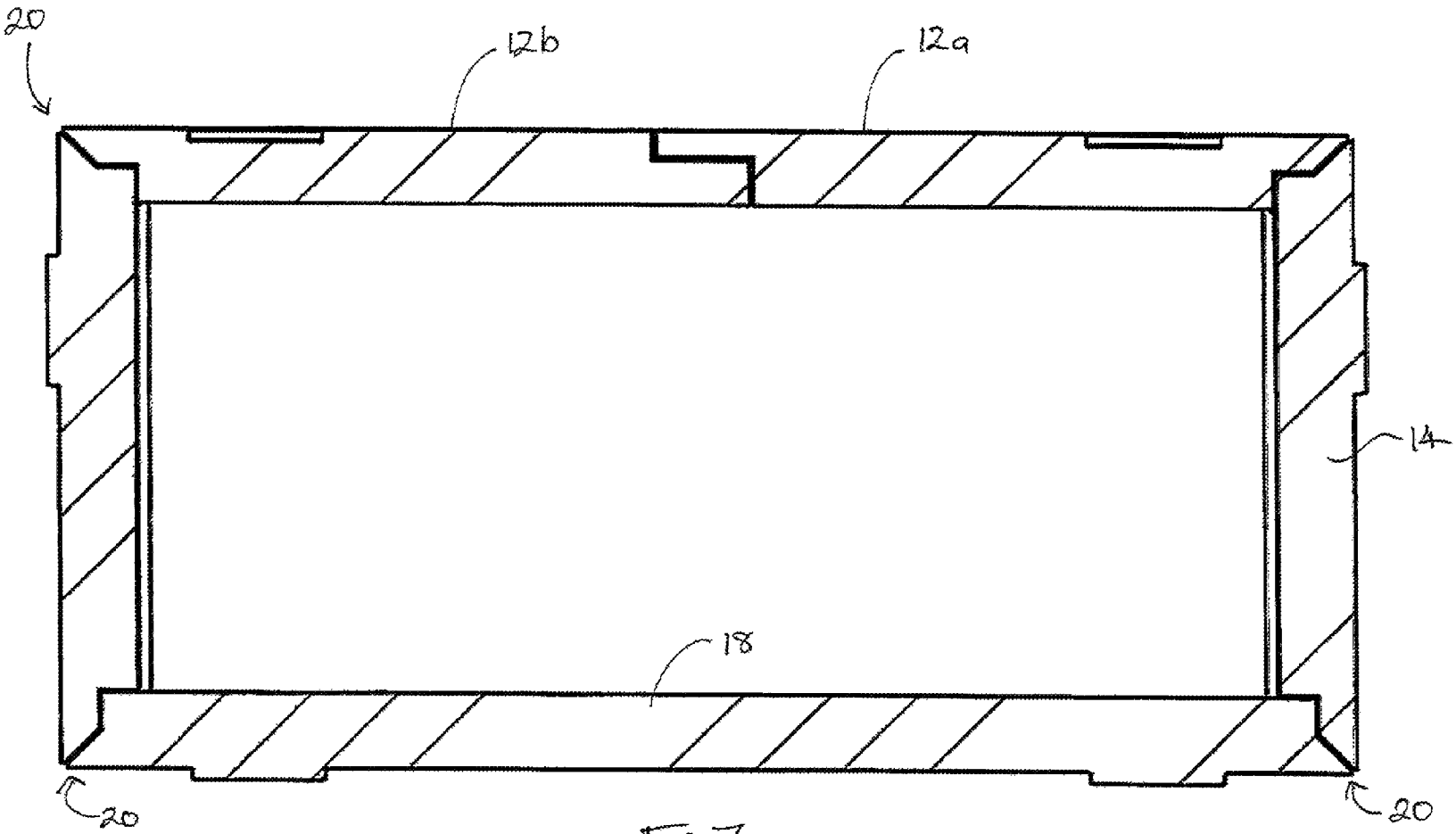
FIG. 7 is a cross-sectional side view of the assembled container of FIG. 1.
Figure 9:
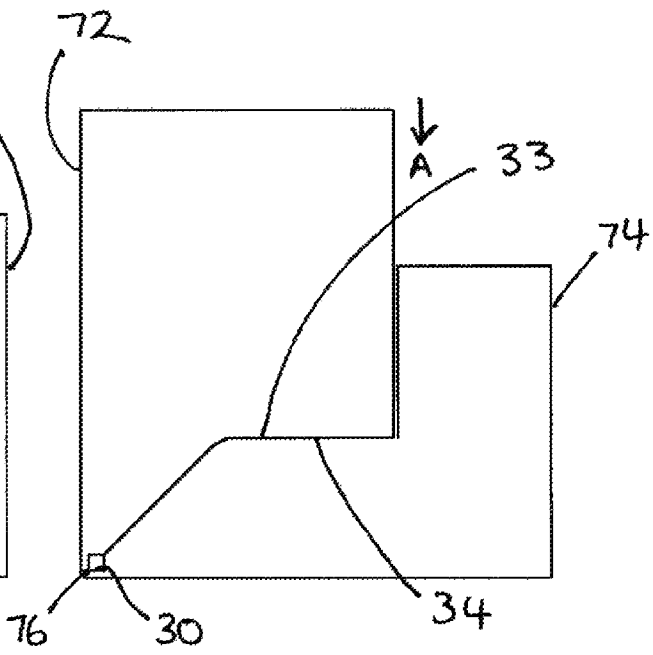
FIG. 9 is an enlarged view of the hinge region of FIG. 8 in assembled form.
Figure 8:
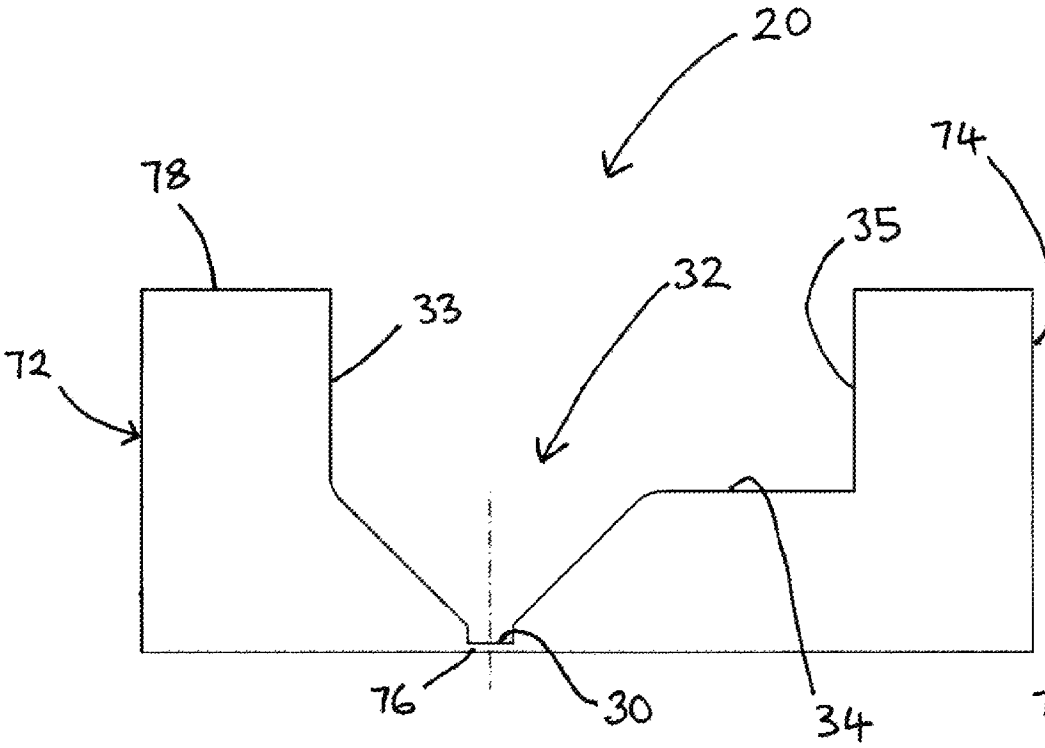
FIG. 8 is an enlarged view of a hinge region according to an embodiment of the present invention.

Referring to FIGS. 7-9 the manner in which the hinges 20 are configured is depicted. The hinges 20 function to provide pivotal movement between the various portions of the container 10 to enable the container 10 to be formed from flat form into a box form. As previously discussed, the hinges are formed by the process described in the Applicants earlier filed International PCT Patent Application No. PCT/AU2010/000340, and will not be described in further detail below.

Each hinge 20 is formed to define a hinge point 30 about which the portions of the blank may be folded, in this example portions 72, 74. A V-shaped groove 32 is formed in the body of the blank such that the portion of the V-shaped groove on either side of the hinge point 30 is identical, namely assumes, preferably, a 45° angle. Two complementary angles may alternatively be used. The hinge point 30 is constituted by a channel located at the base of the V-shaped groove 32, the base of which channel is the narrowest region 76 of material, which connects portions 72 and 74. Once the hinge point 30 is formed, it defines an axis about which folding of the hinge 20 takes place. The channel 32 functions to improve the ability of the hinge 20 to fold back on itself, as well as to fold in the opposite direction during erection of a container 10, as will next be described.

Rather than the hinge 20 being formed in a V-shape, such that the material provided on each side of the hinge point 30 is formed in a mirror image, the material formed on each side of the hinge point is formed differently in order to increase the strength of the hinge 20. At the point where the V-shaped groove 32 terminates, on the portion 72 side of the hinge point the V-shaped groove 32 terminates at a vertical wall 33 and on the other portion 74 side of the hinge point 30 the V-shaped groove terminates at a horizontally extending stepped region 34 that then terminates at a vertical wall 35.

As is shown more clearly in FIG. 9, when the hinge 20 is moved, by pivoting in a clockwise direction from the horizontal configuration shown in FIG. 8 to the exemplary 90° configuration of FIG. 9, the various surfaces of the hinge 20 on either side of the hinge point 30 mesh together. In this regard, the horizontally extending stepped region 34 of the hinge 20 on one side of the hinge point 30 is received against the vertical wall 33 of the hinge on the other side of the hinge point and the vertical wall 35 becomes seated on the upper surface of the blank. Such an arrangement ensures that any downward force applied on the container 10 when assembled, as may occur through stacking containers 10 on top of each other, will act in the direction of arrow A. As the hinge 20 comprises a stepped region and not merely two 45° angled faces, the shear forces present on the hinge as a result of the compression force in the direction of arrow A are significantly reduced. As is shown in FIG. 7, by having hinges 20 at each corner of the container 10, the compression strength of the container is significantly increased.

The hinge 20 of FIGS. 7-9 may also operate in the opposite orientation. Blank portion 74 may be rotated in an anti-clockwise direction from the position shown in FIG. 7, to an exemplary 90° configuration, in which configuration wall 35 would seat on wall 78 of portion 72. In the same way, downward forces on portion 74 would be resisted by wall 78 of portion 72.

Figure 10:
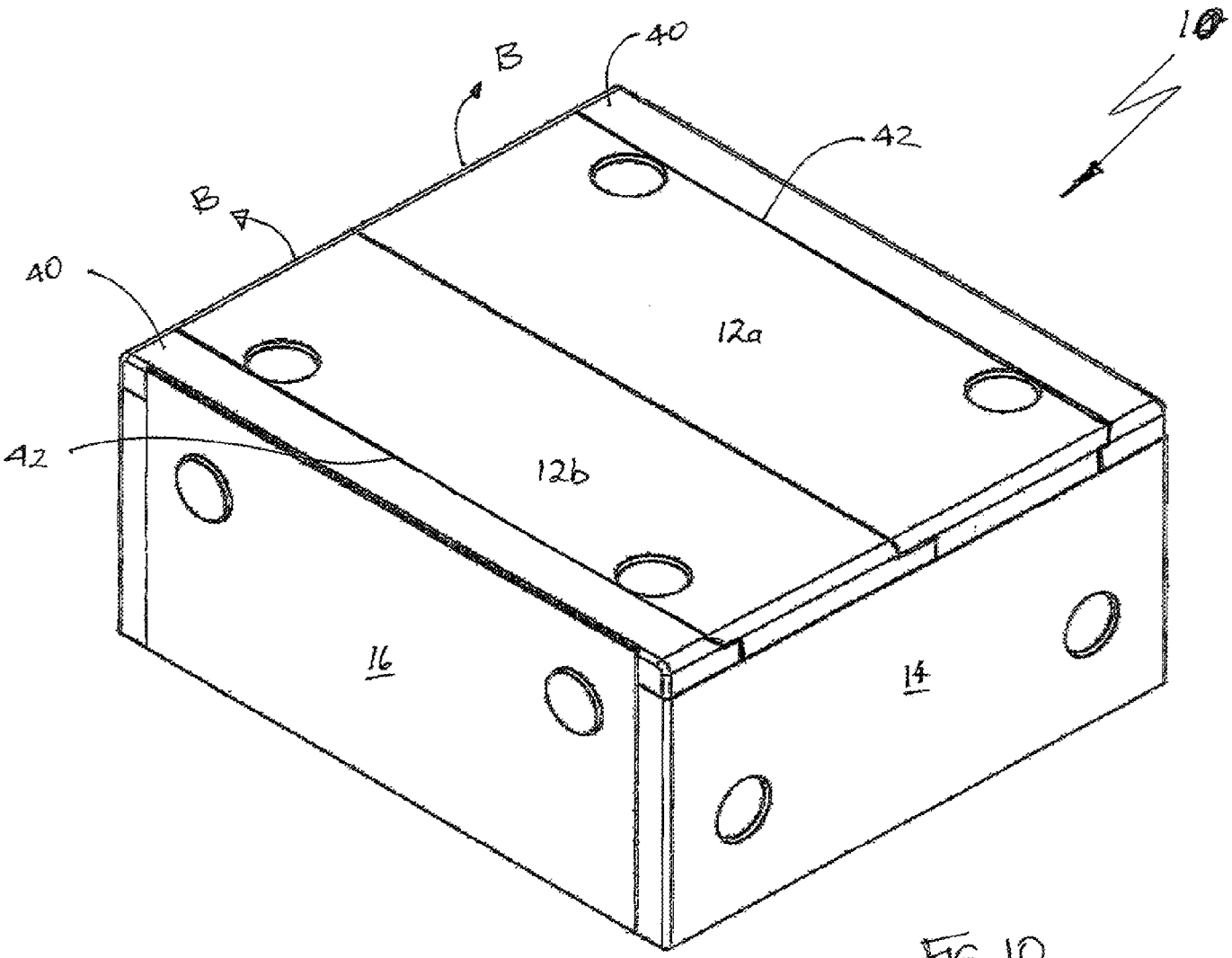
FIG. 10 is a perspective view of an assembled container in accordance with another embodiment of the present invention.
Figure 11:
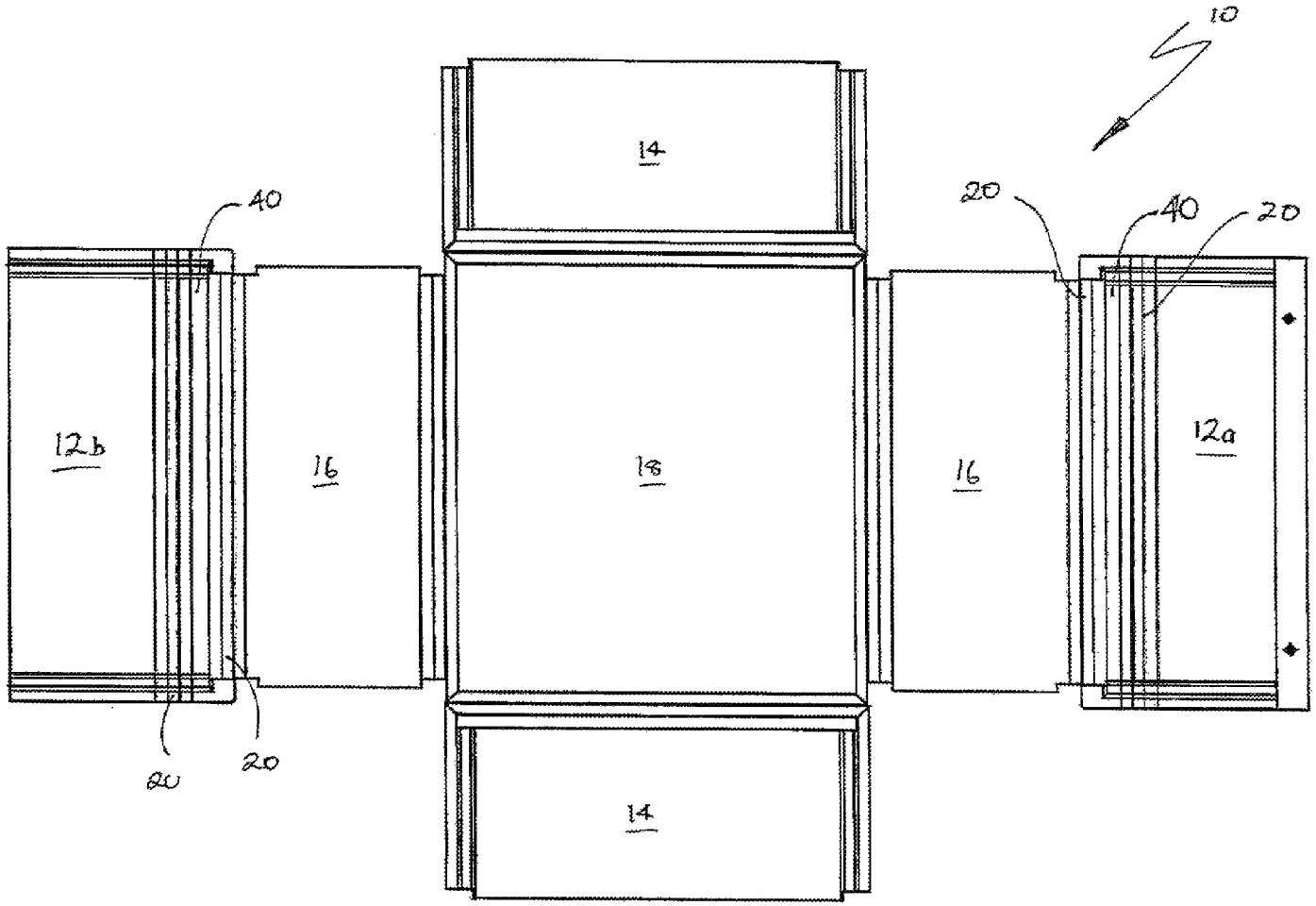
FIG. 11 is a is a top view of the unassembled container of FIG. 10.

Referring to FIGS. 10 and 11, an alternative embodiment of a container 10 in accordance with the present invention is depicted. This embodiment is similar to the embodiment of the invention depicted in FIGS. 1-9, with the difference being the inclusion of an additional hinge 20 in the lid members 12*a* and 12*b* respectively.

As is shown in FIG. 11, each lid member 12*a* and 12*b* comprises an additional hinge 20 to enable the lid members 12*a* and 12*b* to open without breaking the engagement between the lid members 12*a* and 12*b* and the side walls 14. In this regard, the lid members 12*a* and 12*b* are positioned in the manner as discussed above such that the lips 24 of the side walls 14 are received within the grooves 28 formed on the underside of the lid members 12*a* and 12*b*.

By providing an additional hinge 20 on each lid member, represented by hinge line 42 in FIG. 10, each lid member 12*a* and 12*b* may be opened in the direction of arrow B to facilitate loading/unloading of the container 10 and in doing so a part 40 of the lid member 12*a* and 12*b* is retained in place. As the part 40 of each of the lid members 12*a* and 12*b* remains in position, the part 40 provides positive engagement with the side walls 14 thereby ensuring that the integrity of the assembled box is retained and the walls 14 remain in the upright position.

Whilst the embodiments of the container 10 described above provide a more robust and easy to assemble container, that is capable of being loaded/unloaded as desired, the container of the present invention also provides considerable improvements in relation to stacking/storing blanks when not in used.

Figure 12:
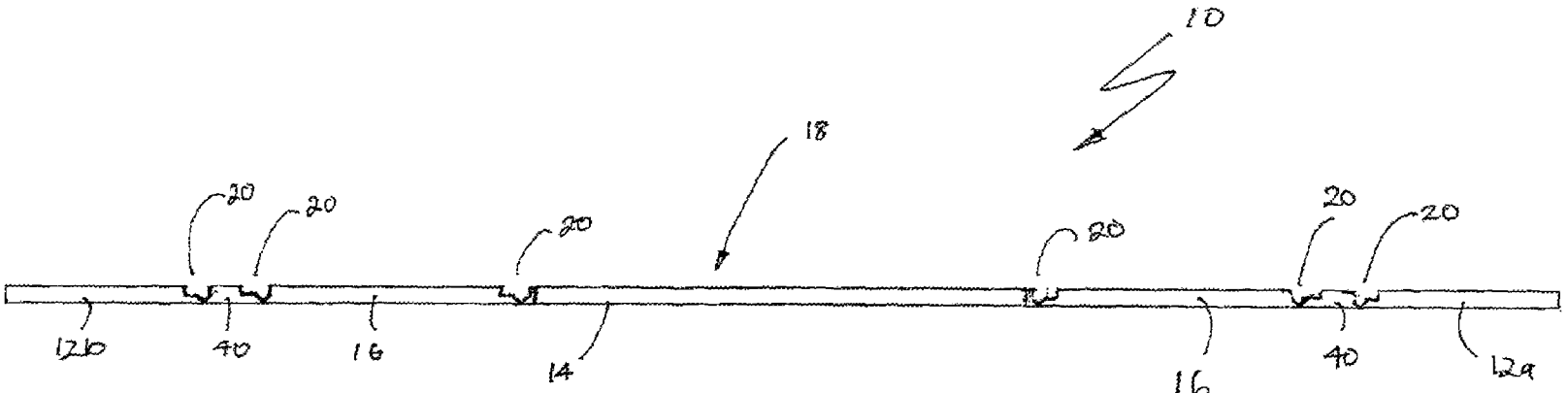
FIG. 12 is a side view of the unassembled container of FIG. 10.
Figure 13:
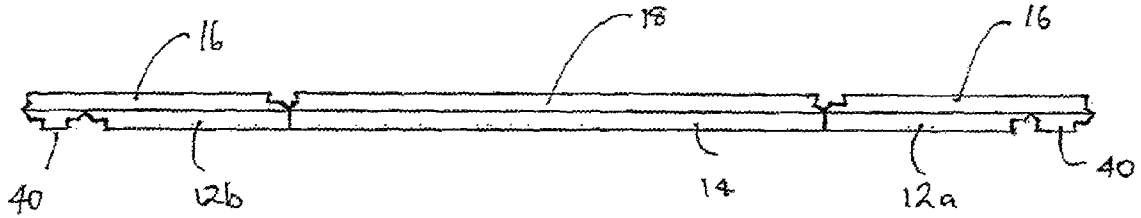
FIG. 13 is side view of the unassembled container in compact mode for storage.

FIG. 12 depicts a side view of the blank depicted in FIG. 11 in expanded form. As the hinges 20 are formed on the upper (or inner) surface of the blank as shown, they are able to fold about an angle of 270° to facilitate compact storage. In this regard, by folding the sidewalls 14 under the base 18 and folding the lid members 12*a* and 12*b* under the end walls 16, as shown in FIG. 13, the blank 10 is able to be formed into a substantially rectangular slab, which may be styled a "compact mode", defined by the combined surfaces of end walls 16 and base 18, which has a uniform thickness. As a result, unused or unassembled/disassembled blanks 10 are able to be stacked in a convenient and simple manner ensuring that no wastage of space results.

Figure 14:
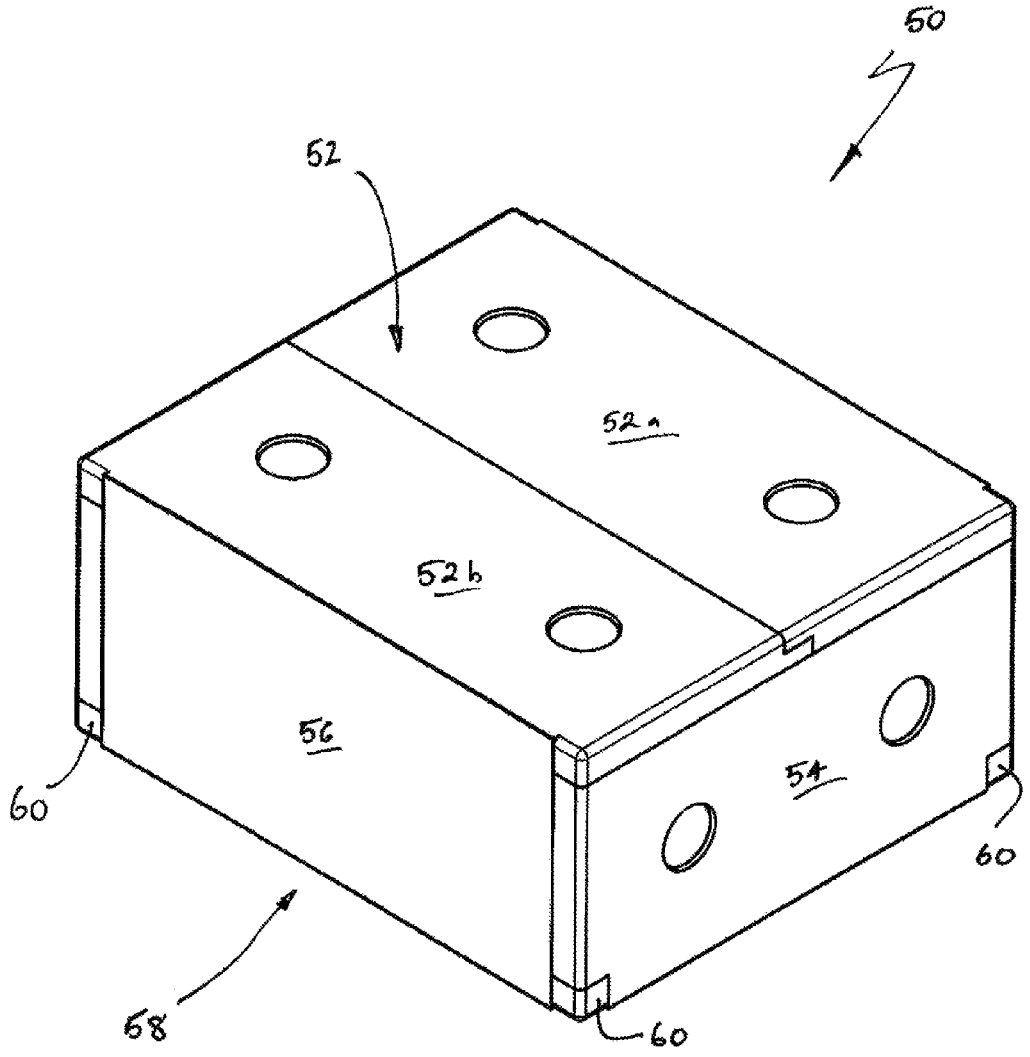
FIG. 14 is a perspective view of an assembled container in accordance with an alternative embodiment of the present invention.
Figure 15:
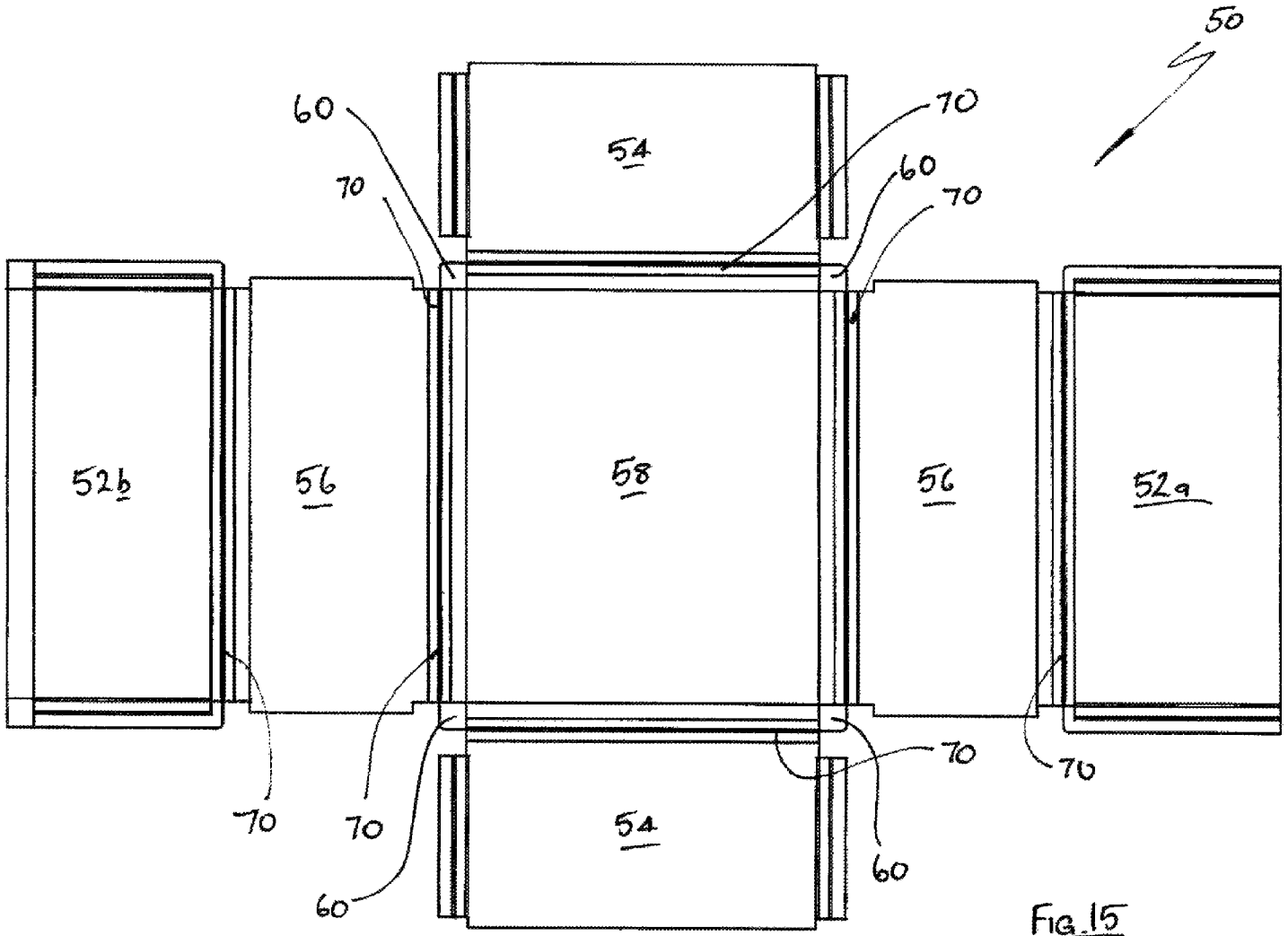
FIG. 15 is a top view of the unassembled container of FIG. 14.
Figure 16:
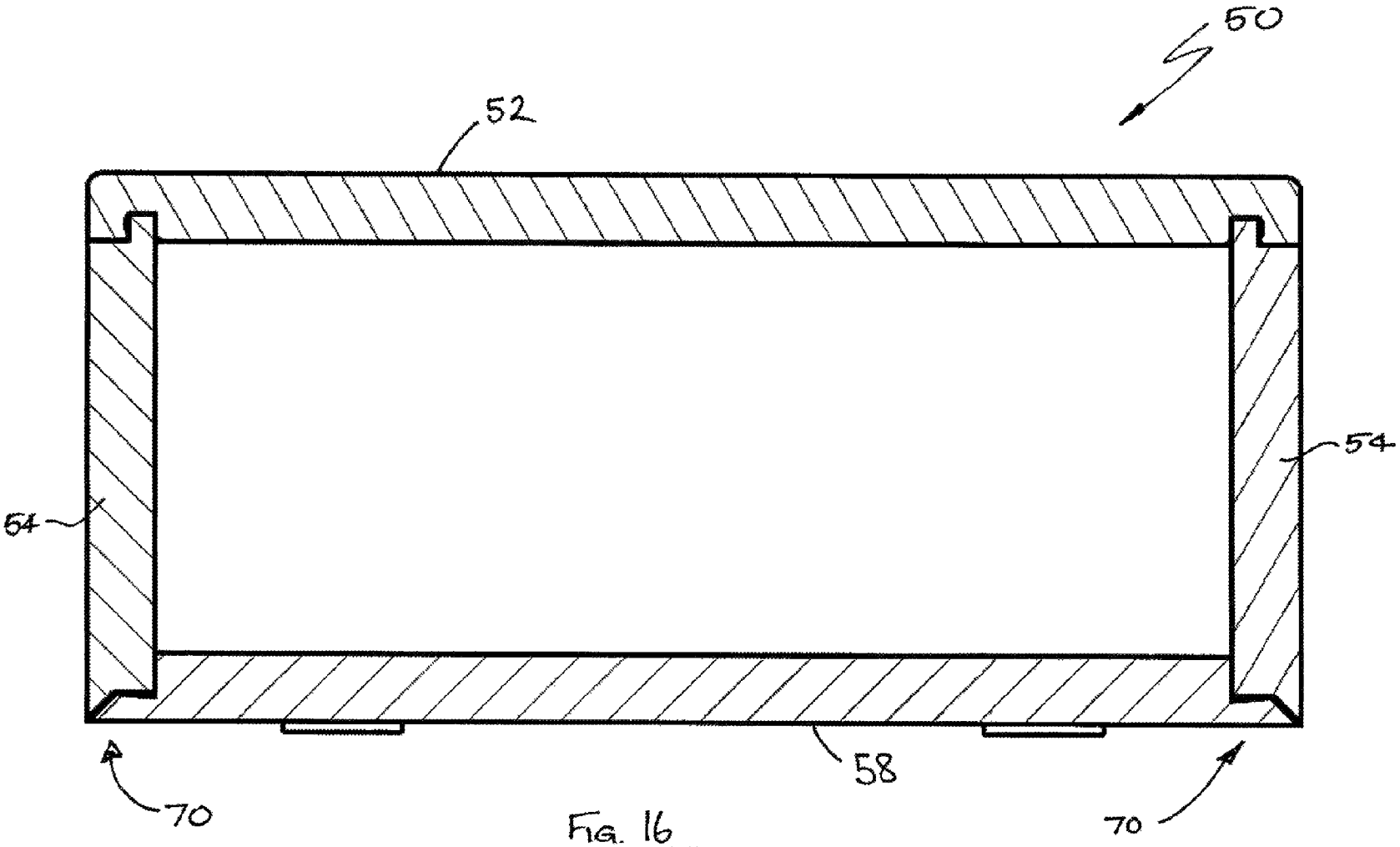
FIG. 16 is a cross-sectional side view of the assembled container of FIG. 14.

An alternative embodiment of the present invention is depicted in FIGS. 14-16. In this embodiment, there is depicted a container 50 in accordance with an embodiment of the present invention. The container 50 is in the form of a blank that is assembled into a rectangular box having a lid portion 52, opposing side walls 54 and opposing end walls 56. A base 58 forms the underside of the container 50 such that the interior of the container represents an enclosed space into which items can be stored or contained as required.

The container 50 is preferably made from EPS with the lid 52, side walls 54, end walls 56 and base 58 having a maximum thickness of between 20-30 mm, preferably around 25 mm. However, other thicknesses are also envisaged.

As is shown in FIG. 15, the container 50 is formed from a substantially flat blank. A plurality of hinges 70 are formed between where the lid 52, side walls 54, end walls 56 and base 58 meet to facilitate bending of the lid 52, side walls 54, end walls 56 and base 58 into the position as shown in FIG. 14. The hinges 70 are formed on the internal surfaces of the blank as shown and the manner in which the hinges 70 are configured are substantially identical to the hinges 20 described in relation to the above embodiment, with the main difference being that the hinges are arranged in an inverted manner to that shown in the above embodiment. This can be readily noted by comparing the hinge 70 depicted in FIG. 16 with that depicted in FIG. 9 as hinge 20. It will be noted that despite the change in orientation between hinges 20 and 70, the fundamental principles remain the same between the hinges, with horizontal support regions of the opposing surfaces of the hinge functioning to bear the weight of the hinge, thereby reducing pressure present on the angled faces of the hinge.

Referring to FIG. 15, the blank of this embodiment also comprises ledge portions 60 which are in the form of substantially flat regions of material located at each corner of the base 58. As depicted, the hinges 70 do not extend into the ledge portions 60.

In use, as depicted in FIG. 15, the ledge portions 60 function to support the hinges at each of the corners of the base of the assembled container 50. When the side walls 54 are folded about the hinges 70 to form the container 50, the corners are supported atop the ledge portions 60. As the base corners of the assembled container 50 are critical load points of the container, the provision of the ledge portion 60 provides a degree of protection to the hinges 70 in these regions, and provides a degree of impact resistance, should the assembled container be dropped and the corner impact with a hard surface. Further to this, the provision of the ledge portions 60 function to separate the base hinges 70 into four distinct sections, which improves the ability to mould the blank and design tooling for the manufacturing process.

It will be appreciated that the resulting container 50, like container 10 provides a strong and robust container that is able to be formed from EPS and which can be stacked in a flat manner when not in use, and assembled for use in a simple and effective folding process.

The ledge portions 60 may be provided elsewhere on the base 58, to support hinges 70. Such ledge portions may be located on and extending from the base 58, beneath hinges 70, and between the corners of base 58, whether or not ledge portions are provided at those corners.

FIG. 16 is a cross-sectional side view of the assembled container of FIG. 14, and is shown with differing hinge arrangements between the base 58 and side walls 54 and the lid members 52*a*, 52*b* and side walls 56. It is preferred for the hinge arrangements at the top of the container 50 to be the same as those shown at the base of container 50, in a similar manner as shown in FIG. 7.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

It will be appreciated by those skilled in the art that many modifications and variations may be made to the methods of the invention described herein without departing from the spirit and scope of the invention.

The entire contents of the description, claims and drawings of Australian provisional patent application no. 2013904133, filed on 25 Oct. 2013, and of Australian provisional patent application no. 2014901686, filed on 7 May 2014, are herewith incorporated into this specification.

The invention claimed is:

1. A container blank including a base and a plurality of side walls, each of said plurality of side walls being connected to said base by a hinge, such that each of said plurality of side walls is able to be pivoted about a respective hinge, relative to said base, to form said container, wherein ledge portions are provided on said base, said ledge portions extending from said base, thereby providing support for said hinge when said blank is erected to form said container.

2. The container blank according to claim 1, wherein said ledge portions are located on said base between adjacent side walls.

3. The container blank according to claim 2, wherein each of said side walls is provided with an end portion extending beyond the respective hinge connecting each of said side walls to said base, such that when said container blank is erected into a container, each said end portion is supported by a respective ledge portion.

4. The container blank according to claim 2, wherein one of a pair of adjacent side walls has an end portion which is configured as a lip, and the other of the pair of adjacent side walls is provided with a groove, which said lip is adapted to engage, when said container blank is erected to form a container.

5. The container blank according to claim 1, wherein said ledge portions are located beneath said hinge.

6. The container blank according to claim 1, wherein said base and each of said plurality of side walls are substantially rectangular, and that said ledge portions are located at the corners of said substantially rectangular base.

7. The container blank according to claim 1, further comprising a lid connected to at least one of said plurality of side walls by a hinge.

8. The container blank according to claim 1, further comprising a lid, said lid being formed from a plurality of lid sections, each of said plurality of lid sections being connected to a respective one of said plurality of side walls by a hinge.

9. The container blank according to claim 5, wherein each of said lid sections is substantially vestigial, such that when said container is erected, the top of said container is substantially open.

* * * * *